US005643146A

United States Patent [19]

Stark et al.

[11] Patent Number: 5,643,146

[45] Date of Patent: Jul. 1, 1997

[54] STATIONARY EXERCISE DEVICE HAVING LOAD-CONTROLLING BRAKING SYSTEM

[75] Inventors: Duane P. Stark, Dana Point; Michael T. Sweeney; James S. Sweeney, Jr., both of Laguna Beach, all of Calif.

[73] Assignee: Tectrix Fitness Equipment, Irvine, Calif.

[21] Appl. No.: 611,806

[22] Filed: Mar. 6, 1996

Related U.S. Application Data

[63] Continuation of Ser. No. 100,275, Aug. 2, 1993, abandoned.

[51] Int. Cl.[6] ..... A63B 23/04

[52] U.S. Cl. ..... 482/63; 482/5

[58] Field of Search ..... 482/57, 64, 51, 482/52, 53, 1, 2, 4–9, 63, 900, 901, 903

[56] References Cited

U.S. PATENT DOCUMENTS

| | | | |
|---|---|---|---|
| 334,635 | 1/1986 | Bowen . | |
| 3,621,948 | 11/1971 | Dimick | 482/64 |
| 3,767,195 | 10/1973 | Dimick et al. . | |
| 3,845,663 | 11/1974 | Bloomberg | 482/64 |
| 4,007,927 | 2/1977 | Proctor . | |
| 4,358,105 | 11/1982 | Sweeney, Jr. . | |
| 4,509,742 | 4/1985 | Cones . | |
| 4,558,861 | 12/1985 | Gall | 482/64 |
| 4,592,544 | 6/1986 | Smith et al. . | |
| 4,770,411 | 9/1988 | Armstrong | 482/64 |
| 4,809,970 | 3/1989 | Beistegui | 482/64 |
| 4,934,692 | 6/1990 | Owens . | |
| 4,938,474 | 7/1990 | Sweeney | 482/52 |
| 4,938,475 | 7/1990 | Sargeant et al. . | |
| 4,953,415 | 9/1990 | Lehtonen | 482/64 |
| 4,976,424 | 12/1990 | Sargeant et al. . | |
| 5,067,710 | 11/1991 | Watterson | 482/64 |

OTHER PUBLICATIONS

"*BIKEMAX, the first really new exercise bike in over fifteen years*", National Fitness Trade Journal, Fall, 1993, pp. 6–8.

*Primary Examiner*—Stephen R. Crow
*Attorney, Agent, or Firm*—Thomas J. Plante

[57] ABSTRACT

A stationary exercise cycle is disclosed having a drive wheel which receives both user driving force and automatically controlled friction brake resistance, i.e., it is a single-stage device. Free-wheeling is provided between a user-driven shaft and the periphery of the drive wheel, which is braked by a friction belt. Automatic resistance control is provided by an electronic system, which receives actual load information from a load cell, and RPM information from a speed sensor. The friction belt is tightened or loosened by a motor-driven pulley, in response to signals indicating an "error" between load command and actual load. The load information is accurately obtained by a pivoted member to which both ends of the friction belt are attached.

24 Claims, 8 Drawing Sheets

STATIONARY EXERCISE DEVICE HAVING LOAD-CONTROLLING BRAKING SYSTEM

This application is a continuation of application Ser. No. 100,275, filed Aug. 2, 1993, now abandoned.

BACKGROUND OF THE INVENTION

This invention relates to exercise apparatus, and particularly to an exerciser, such as a stationary exercise cycle, which is caused to control automatically the levels of exercise effort exerted by the user. It is directed primarily to a cycle exerciser loaded by a braking system, although the novel concepts disclosed are applicable to other types of exercisers.

In the field of stationary exercise cycles, one of the best known is sold under the trademark "Lifecycle". It provides a varying load by incorporating a "dynamic" brake, in the form of an alternator, whose resistance to user-caused rotation of the cycle is varied by varying field current in the alternator (Sweeney U.S. Pat. No. 4,358,105, assigned to Lifecycle). An alternator brake has certain benefits, including the fact that it supplies electrical current needed to operate the control and display circuitry of the exerciser.

The use of a dynamic brake has certain significant limitations. It is not effective until a minimum load level has been reached, a level which is high enough to substantially restrict the lower end of the operating range. Furthermore, it requires a multi-stage speed-increasing system to bring the alternator speed to the necessary RPM. The angular speed ratio of the alternator to the user-driven wheel needs to be about 25 to 1. Exercise cycles using alternator brakes generally have two drive stages in order to translate the 60–150 RPM pedaling speed into the 1500–3000 RPM operating range of the alternator. The power transmission system is a source of noise and maintenance (endurance) problems, because of the high force being transmitted. Such a system also requires expensive drives and bearings, and lacks the desired smoothness in its operation.

Some exercise cycles on the market use other types of brake control as load-determining devices. One type of brake used is an electrical energy brake, referred to as an "eddy current" brake. Its problems are similar to, and generally greater than, those of the dynamic brake.

Other exercise cycles use mechanical friction, which was used in this field prior to the dynamic brake. Dimick U.S. Pat. No. 3,621,948 (also assigned to Lifecycle) used a band brake, which exerted direct mechanical friction by engagement with the periphery of a flywheel. Another version of direct mechanical braking is the use of caliper brakes applied to opposite sides of the rotor, i.e., using the rotor as a disk in a disk brake.

Another type of friction brake arrangement is shown in Smith et al U.S. Pat. No. 4,592,544. In the latter patent, the user-driven pedals drive a set of gears, which in turn drive a flywheel rotating about a vertical axis. A manually-adjusted band brake engages the periphery of the flywheel.

Stationary exercise cycles using eddy current or friction brakes typically use a single speed-increasing stage, in order to increase the angular momentum of the braked flywheel. When the second stage or third stage is braked, the primary drive stage must transmit considerable torque at low speed, which typically requires a heavy-duty transmission, such as a chain and sprockets.

From extensive experimentation, and for the reasons stated above, the present inventors have concluded that it is highly desirable to have the braking force applied to a single-stage cycle, i.e., applied directly to the same rotating member (the "first stage") as the one driven directly by the user-operated pedals. Highly significant advantages result from eliminating the intermediate driving stage, or stages, between the cycle and the brake.

The present inventors are unaware of any automatically controlled commercial exercise cycle in which the braking force is applied to the first stage of the cycle.

A prior art search has yielded at least two patents showing stationary exercise cycles having first stage braking: Proctor U.S. Pat. No. 4,007,927 and Bowen U.S. Pat. No. 334,635. Proctor shows a caliper brake on a pedal-driven flywheel. Bowen shows a shoe brake engaging the peripheries of a pair of pedal-driven wheels. Both Proctor and Bowen use manual braking force adjustors. Neither of these patent disclosures can satisfy the need for a smoothly-functioning, high endurance, automatically-controllable stationary exercise cycle.

STATEMENT OF THE INVENTION

The present invention provides the first practical embodiment of a first stage automatically controllable exercise cycle, i.e., an exercise cycle in which the rotor (wheel) "attached" to the pedals is the same rotor to which braking force is applied for load-creating purposes. The attachment of the pedals to the rotor includes a one-way clutch to accommodate the opposing forces.

In an exercise cycle having a first stage brake, it is generally necessary to provide a second rotor, which is driven by the braked rotor, and which has sufficient stored energy to maintain smooth operation through the "dead points" of the user's pedal-created energy.

Additional features of the present invention include a novel structure for measuring the actual load, so that the braking effort can be automatically and accurately adjusted to substantially maintain the user-desired resistance.

The applicants have experimented with various brakes, leading to a preference for a band brake which engages the periphery of the first rotor. A motor and pulley structure are connected to the band brake, for the purpose of causing tightening and loosening of the band brake on the rotor.

The load-measuring feature referred to above comprises a pivoted member, which carries the motor and pulley, and which operates an electro-mechanical torque-measuring device, such as a load cell, by means of slight pivotal motion of the pivoted member.

Another significant feature is the development of a friction band for the first rotor which combines the benefits of a higher coefficient of friction, longer life (greater wear resistance), and quieter operation, when compared to those used in prior exercise devices.

DETAILED DESCRIPTION OF THE DRAWINGS

Figures 3, 8:
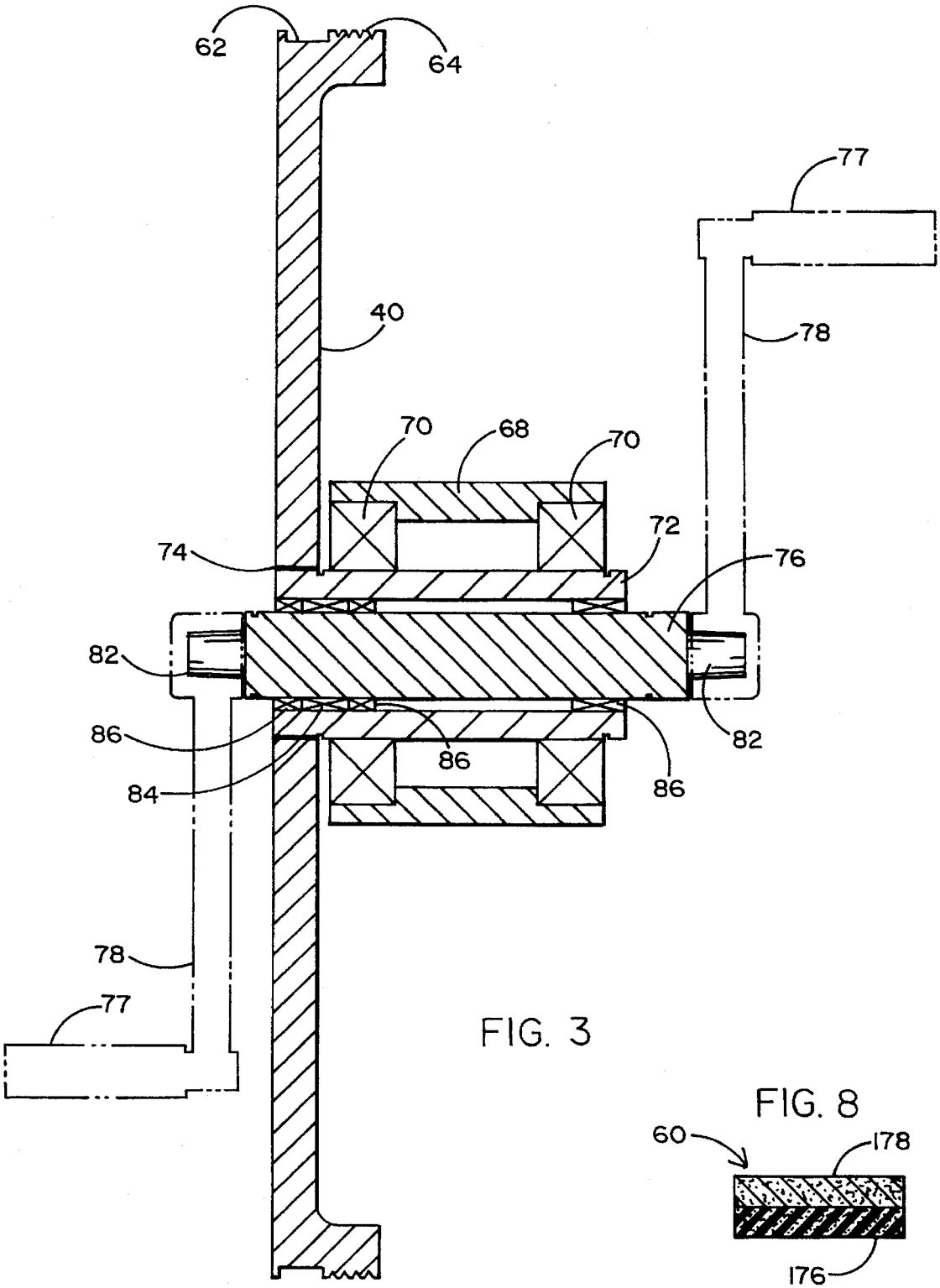
FIG. 3 is a cross-section through the first rotor (driving wheel) and its supporting and controlling structures.
Figure 7A:
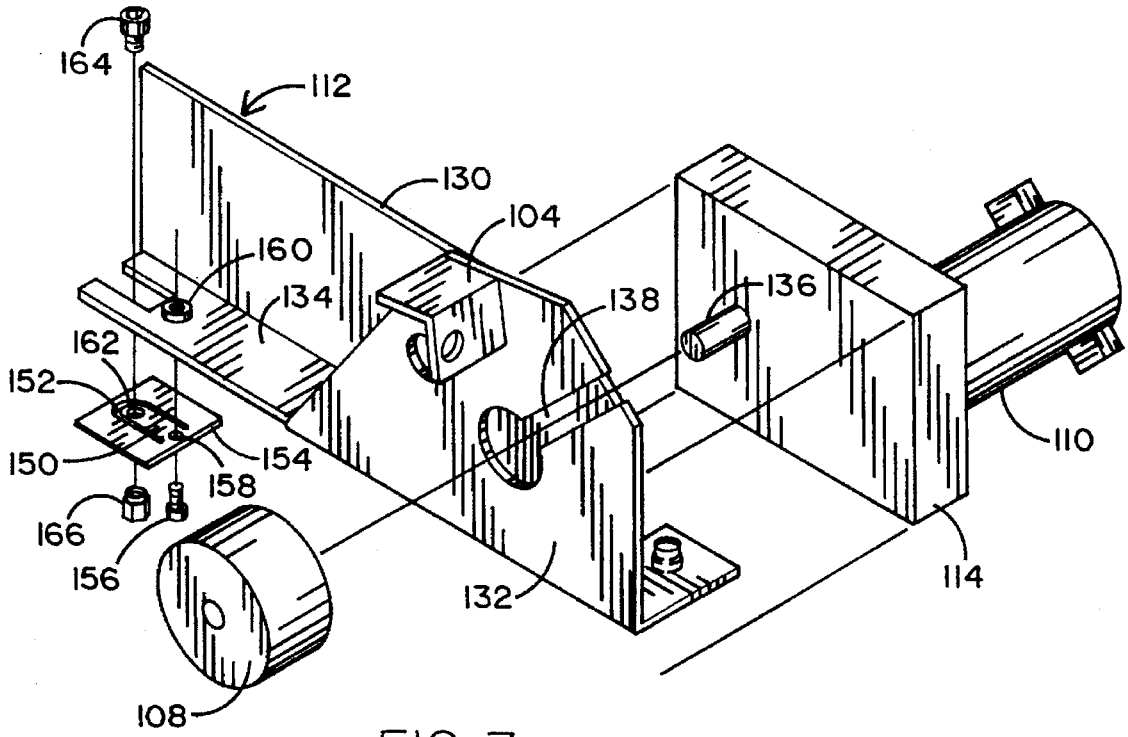
Figure 7B:
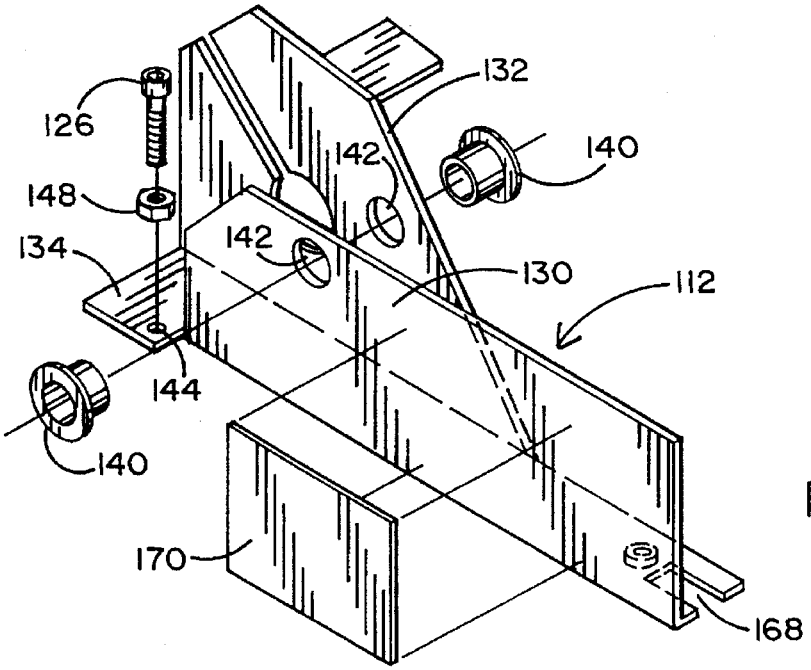

FIGS. 7*a* and 7*b* are isometric, exploded views of the motor-supporting pivoted bracket, taken from opposite sides;

FIG. 8 is a cross-section through the novel friction belt and

Figure 9:
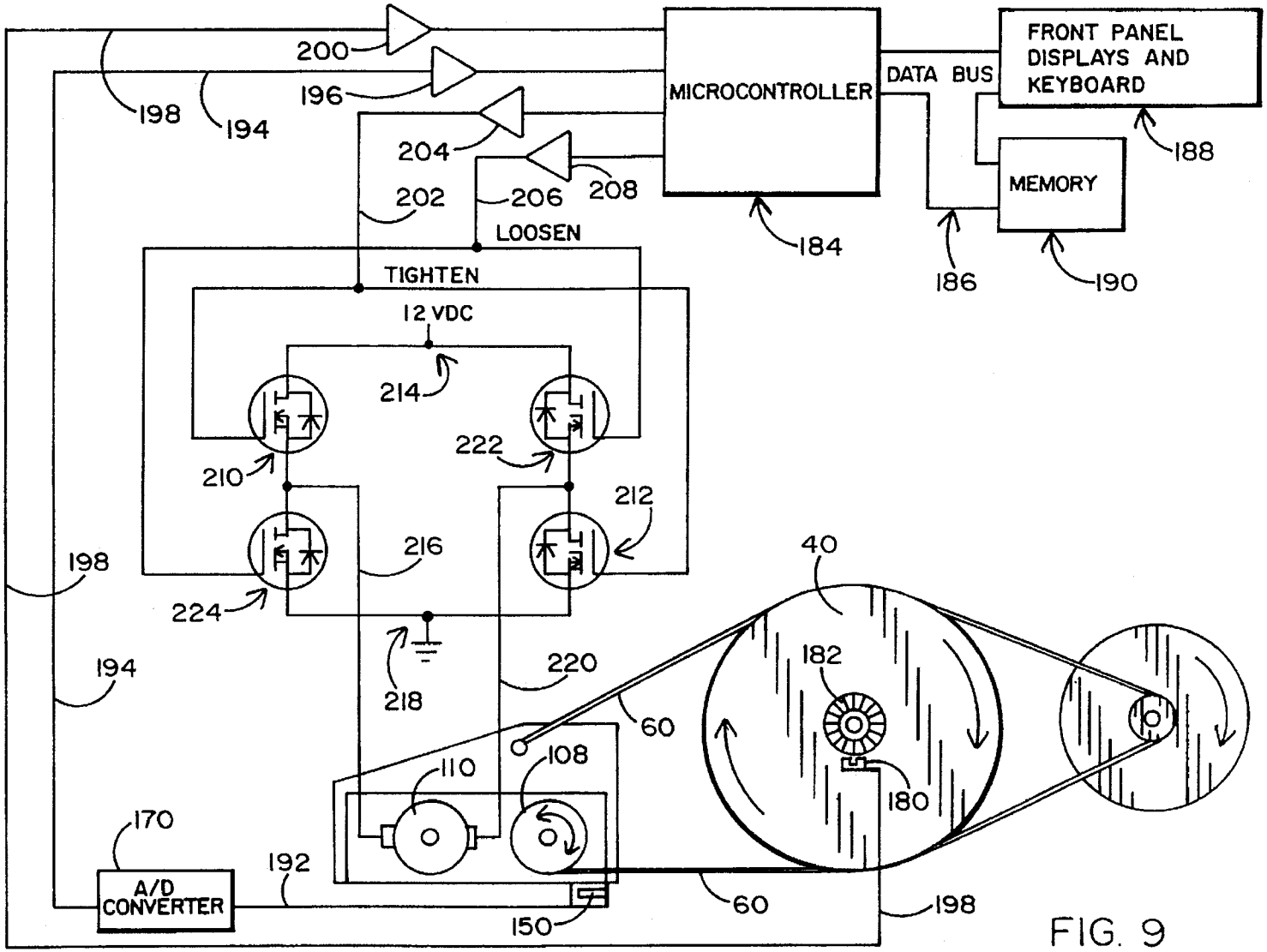

FIG. 9 is a diagram showing an electronic load controlling system.

DETAILED DESCRIPTION OF THE PREFERRED EMBODIMENT

The novel apparatus of this application has a large drive wheel driven directly by the pedals. An internal clutch permits free wheeling. The drive wheel is braked with a belt, and uses another belt to turn a smaller flywheel whose function is to store momentum. During a pedal stroke, power is applied only intermittently; there is a "dead zone" at the top and bottom of each stroke. Without the second flywheel, the drive wheel may come to a stop in the dead zones, if a moderate to heavy braking force is applied. The momentum flywheel stores energy during the power stroke and releases it immediately afterwards. The torque requirements of this secondary stage are such that a medium duty belt transmission may be used.

Figure 1:
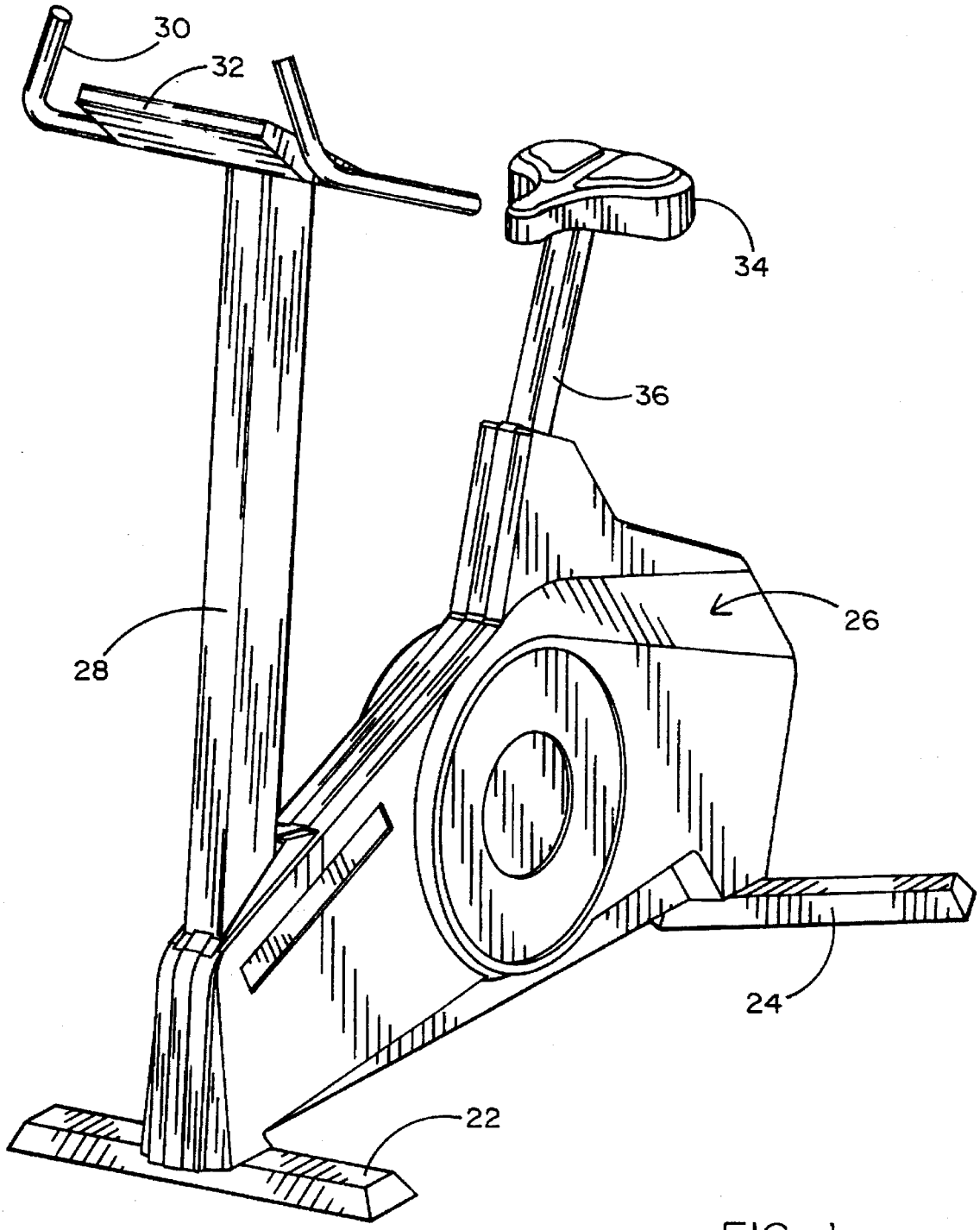
FIG. 1 is an isometric view showing the exterior of a novel stationary exercise cycle.

FIG. 1 is an isometric showing the exterior of a stationary exercise cycle. A supporting frame includes front and rear laterally-extending horizontal supports 22 and 24. A cover 26 encloses the rest of the frame and most of the functioning parts of the cycle (not shown in FIG. 1). A frame post 28 carries handlebars 30 and a display unit 32. A seat 34 for the user is secured to a column 36, which is carried by the frame, and is vertically adjustable by the user.

Figure 2:
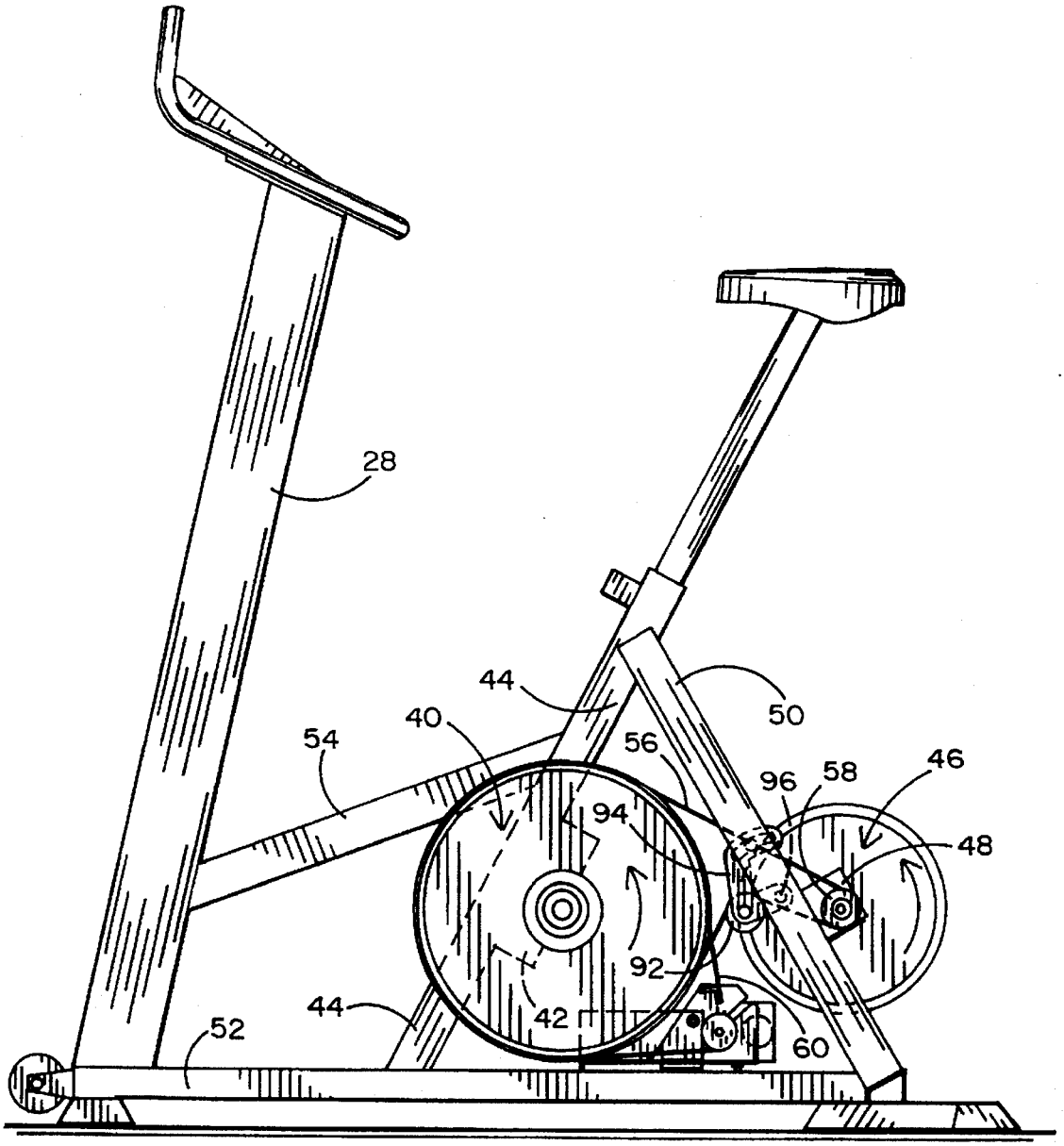
FIG. 2 is a side elevation proving an overall view of the functional elements of the novel stationary exercise cycle.

FIG. 2 is a side elevation showing the functional elements of the novel cycle. A first rotor 40, referred to as the drive wheel, is the rotor which is both driven by the user, and braked by the load-providing system. Support for the first rotor 40 is provided by a bracket 42, secured to a post 44, which is part of the fixed frame.

A second rotor 46, referred to as the momentum flywheel, is used to maintain momentum during the dead spots in the pushing effect of the user-driven pedals associated with the first rotor 40. The second rotor 46, as shown in the illustrated embodiment, is located behind the first rotor 40, and is supported by a bracket 48, secured to a post 50, which is part of the fixed frame. The top of post 50 is secured to post 44, and the lower ends of both posts 44 and 50 are secured to a horizontal supporting member 52 included in the frame, which is secured to the front and rear lateral supports 22 and 24. A brace 54 between posts 44 and 28 essentially completes the frame.

The first rotor 40, in the preferred embodiment, has two bands engaging its periphery. One is a drive belt 56 which causes rotation of the second rotor 46 by driving a pulley 58 secured to rotor 46. The other is a friction belt 60 which is tightened or loosened on rotor 40 to control the load which resists the user's pedal-applied energy.

Figure 4:
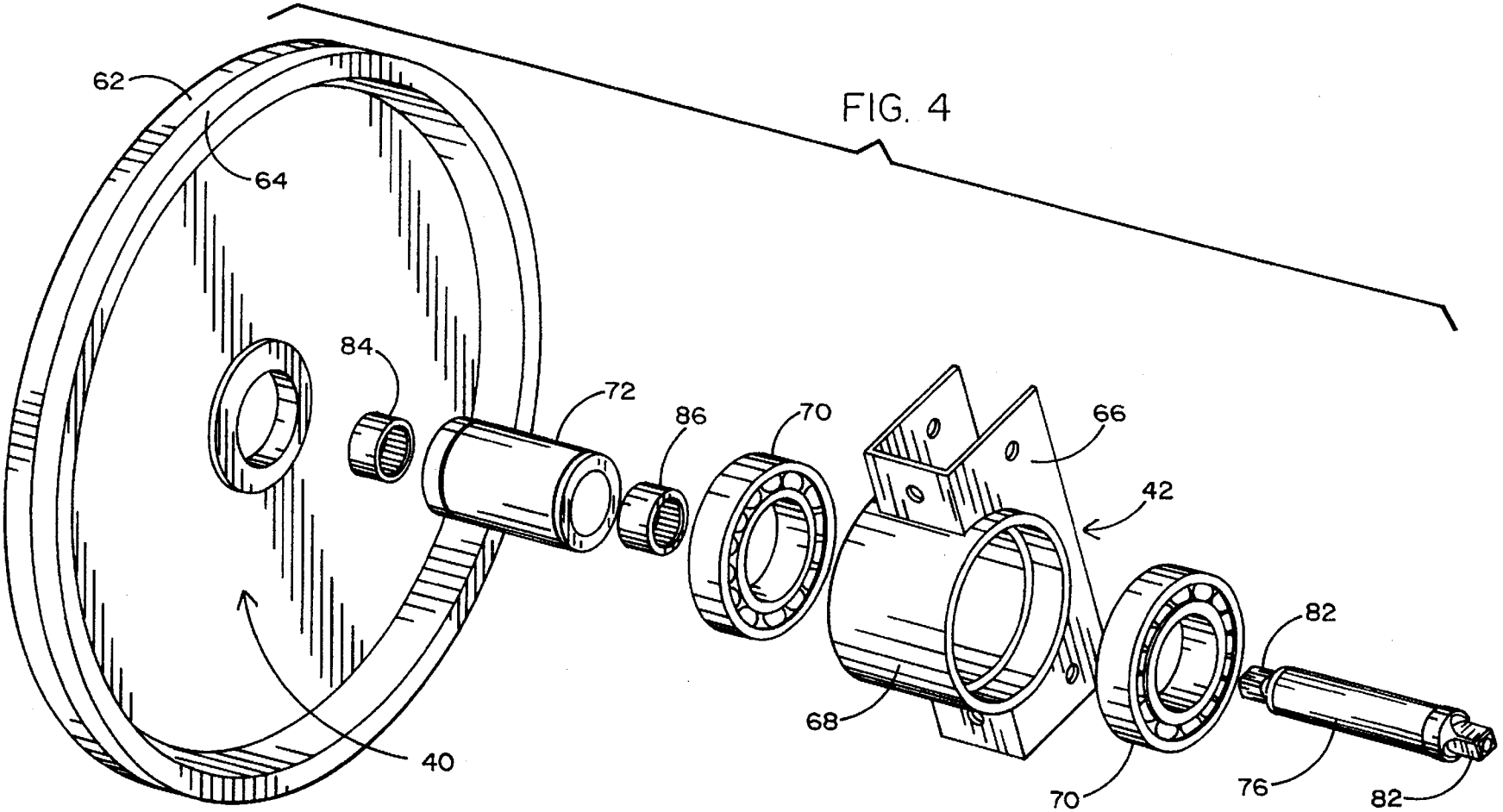
FIG. 4 is an exploded view showing the primary elements of FIG. 3.

FIGS. 3 and 4 show details of the special driving structure for rotor 40, required because it is used both (1)for user-driving, which uses one-way freewheel clutching, and (2) for receiving variable braking resistance. As seen in the vertical section shown by FIG. 3 and the exploded view in FIG. 4 showing major elements, the periphery of rotor 40 has two side-by-side belt-engaging surfaces. Surface 62, which is recessed, is the one engaged by the friction belt 60. Surface 64 is engaged by the belt 56 which drives the second rotor (momentum flywheel) 46. The preferred belt 56 for transferring energy between rotors 40 and 46 is a Poly-V drive belt, which is a polyester belt having a plurality of parallel longitudinal ridges fitting into parallel longitudinal grooves in the surface 64 of rotor 40 and in the periphery of rotor 46. Poly-V belts are very effective for transmitting driving energy, and at the same time are quiet and smooth in their operation.

The bracket 42, which supports the first rotor (drive wheel) 40 includes flanges 66 secured to post 44 and a cylindrical portion 68. Bearings 70 inside cylinder 68 support a rotatable drive wheel hub 72, which is secured at 74 (e.g., by welding) to the center of drive wheel 40.

The user-supplied energy is exerted by a clutch shaft 76, which extends through the center of drive wheel hub 72. The driving effort is supplied by pedals 77 which are pivoted on the outer ends of crank arms 78. The inner ends of crank arms 78 have square holes fitting on square extensions 82 which are part of the clutch shaft 76.

As the user pushes on pedals 77, crank arms 78 cause clutch shaft 76 to rotate. Clutch shaft 76 drives hub 72 and wheel 40 through a one-way roller clutch bearing 84. Because this is a one-way freewheeling clutch, it causes the clutch shaft 76 to rotate drive wheel 40 in one direction, and otherwise allows free-wheeling motion. This freewheeling is needed to allow the user to stop pedaling without affecting, or being affected by, the braking and momentum portions of the system. Additional roller beatings 86 are installed between the clutch drive shaft 76 and drive wheel hub 72. Note that clutch bearing 84 is located as close as possible to the plane of rotor 40.

Figure 5:
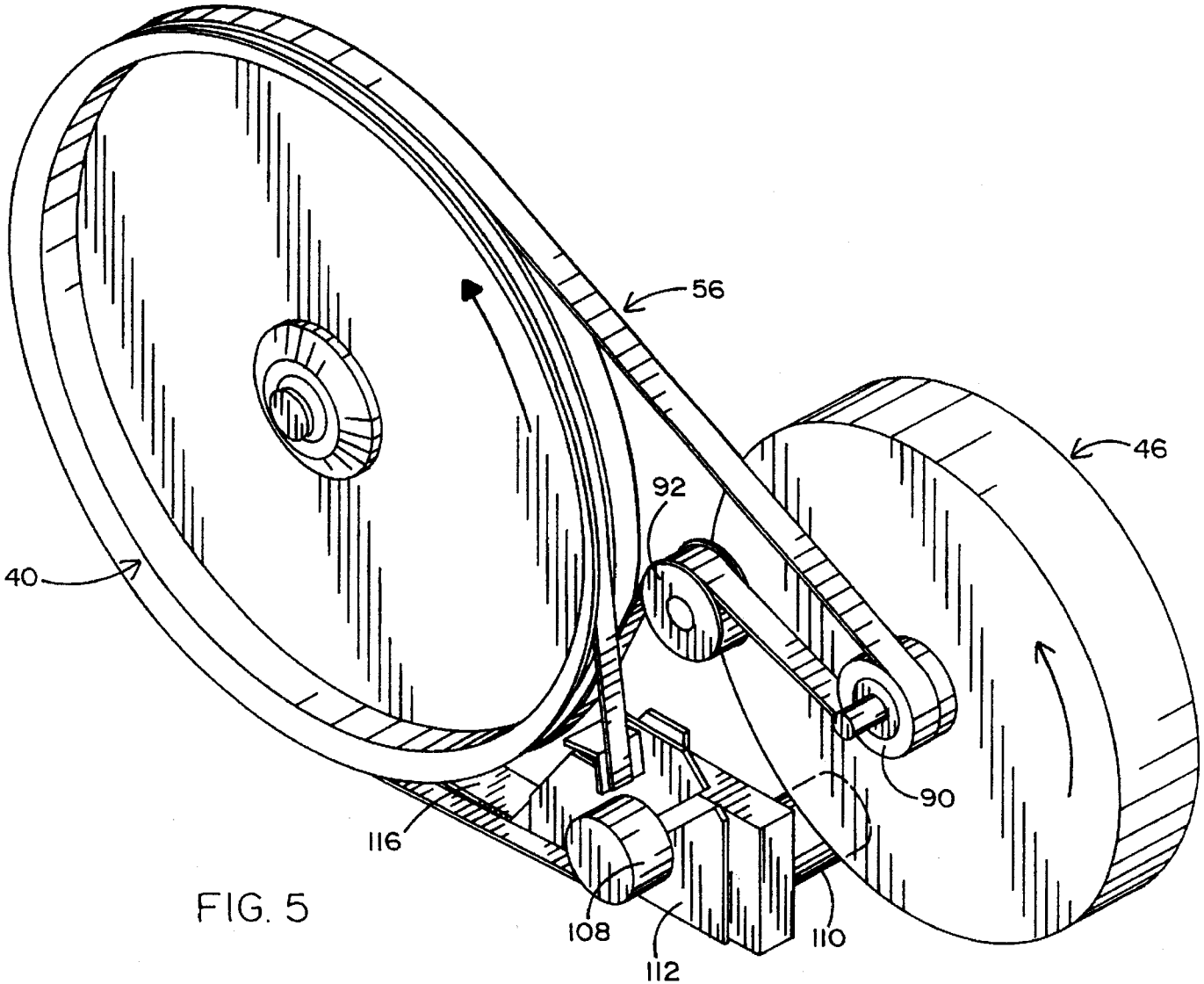
FIG. 5 is an isometric close up of the primary elements of FIG. 2.

FIG. 5 is an isometric close up of the primary functional portions of the system shown in FIG. 2. The Poly-V belt 56, which is continuous, is shown engaging the periphery of the first rotor (drive wheel) 40 and engaging the periphery of a small diameter pulley 90, which drives the second rotor (momentum flywheel) 46. The flywheel is thus caused to have a significantly greater angular speed than the drive wheel.

Because of the braking load on drive wheel 40, discussed in detail below, the use of the momentum flywheel is generally considered necessary. As stated above, during a pedal stroke power is applied only intermittently to wheel 40; there is a "dead zone" at the top and bottom of each stroke. Without the flywheel 46, the drive wheel would come to a stop in the dead zones, if a moderate to heavy braking force is applied. The momentum flywheel stores energy during the power stroke and releases it immediately afterwards.

The tension on belt 56 is adjustable by moving an idler pulley 92, which engages belt 56 between wheels 40 and 46. Idler pulley 92 is mounted on a supporting arm 94 (FIG. 2), which is pivotally connected at 96 to post 50. As arm 94 is moved clockwise on pivot 96, it increases the tension of belt 56; and as it is moved counter-clockwise, it reduces the tension of belt 56. An extension of arm 94 has an arcuate slot, through which extends a bolt mounted on post 50. A nut (not shown) engaging the bolt is tightened to hold arm 94 in position after adjustment.

FIGS. 5, 6, 7*a* and 7*b* show details of the brake-controlling structure, which is an important feature of the present invention. It is useful for automatic measurement of the frictional resistance created by any friction belt used in an exercise device. The friction belt 60, which is adapted to place a braking load on drive wheel 40 by engaging the periphery of the wheel, has its fixed end 103 secured to an anchor 104. The other end 106 of belt 60 is secured to, and wrapped partially around, a pulley 108, which is caused to rotate in either direction by a motor 110. Pulley motion in one direction increases the tension of the belt and tends to cause increased friction between the belt and the drive wheel, thereby increasing the resistance to the user's pedal-applied energy. Motion in the other direction reduces the tension of the belt. Gearing between the motor 110 and the pulley 108 permits a small low-torque, high-speed motor to apply adequate torque to turn the pulley. Because a significant frictional force is needed, the friction belt 60 may be used in a self-energizing mode, i.e., the frictional force between the belt and wheel 40 adds brake-applying force to that exerted by the motor and pulley (note the arrow indicating direction of rotation of wheel 40).

The use of pulley 108 as the means for tensioning friction belt 60 has significant practical advantages over prior art structures. Other cycles using a friction belt apply tension to the belt by means of an idler arm pushing against the belt. In the present invention, use of a wrapping pulley (a) inherently compensates for belt stretching, (b) avoids applying a force normal to the belt, and (c) provides fast and accurate operation.

Because automatic control of the resistance load is desired, means are required to continually measure the load being applied to the drive wheel. This is accomplished by a unique arrangement for exerting force on an electro-mechanical load measuring device, such as a load cell. The load cell is actuated by a pivoted member, also referred to as a motor bracket assembly, which carries the motor and both ends of the friction belt. The motor bracket assembly is pivotally mounted on the frame. The torque exerted on the motor bracket assembly when the drive wheel is rotated, which is proportional to the braking torque exerted on the drive wheel, is measured using a load cell mounted on the motor bracket assembly. At least three concepts are involved in maximizing accuracy of the load cell data: (1) the force on the load cell should be as close as possible to linear in the direction of flexion of the load cell; (2) the force on the load cell must be low enough to be within the range of its capacity; and (3) the "at rest" condition of the load cell should be accurately determined. The first two concepts are incorporated into the mechanical design, and the third concept can be dealt with by electronic control software.

A pivoted bracket 112 is provided, on which anchor 104, pulley 108, and motor 110 are mounted. A gear box 114, which can be purchased as a part already attached to motor 110, is also carried by bracket 112. Bracket 112 has a relatively long arm 116 which carries a load cell 118, containing one or more strain gauges. Bracket 112 has a pivotal support 120 mounted on a fixed bracket 122 welded to the cycle frame.

Figure 6:
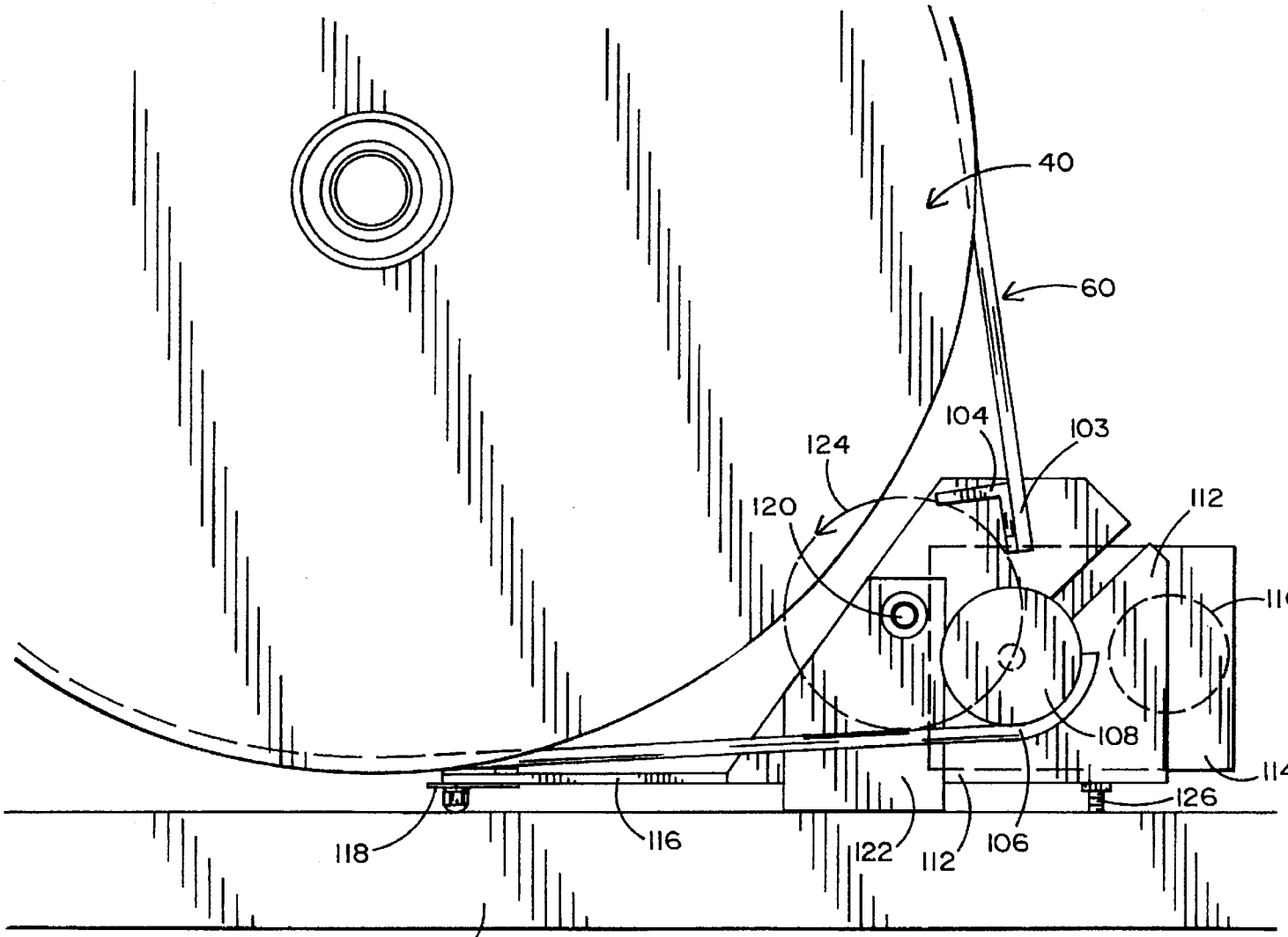
FIG. 6 is a side elevation showing a close up of the brake-controlling motor which acts on the friction belt.

The need for substantially linear force on the load cell is met primarily by location of the pivotal support 120 about which the bracket 112 rotates. Pivotal support 120 is at the center of an imaginary circle 124 (FIG. 6), which is tangent to both ends of the friction belt, i.e., anchored end 103 and pulley-engaging end 106. When the pivoted bracket 112 is in its at rest position, its heavy end is spaced from the frame by engagement of an adjustable screw 126 with the frame. When braking force is applied to wheel 40 by friction belt 60, a force is exerted on bracket 112 urging it to move, as seen in FIG. 6, in a counterclockwise direction around pivotal support 120. This exerts a force tending to flex the load cell 118. Electrical signals caused by flexion of the load cell are fed into the control system of motor 110, as described in detail below.

FIGS. 7*a* and 7*b* are isometric, exploded views of pivoted bracket 112 and the components supported by it. FIG. 7*a* views the parts from the same side as the previous figures, and FIG. 7*b* views them from the opposite side. Bracket 112 has two vertical sides 130 and 132 joined by a horizontal floor 134. The combined motor 110 and gear box 114 have a shaft 136 which drives pulley 108. Those elements may be preassembled and then mounted on floor 134 between sides 130 and 132 by moving shaft 136 along a slot 138 until gear box 114 rests on floor 134, where it is secured by suitable fasteners. Two bearings 140 extend through holes 142 in the sides 130 and 132 of the bracket, in order to provide its pivotal support. Screw 126, which supports the bracket in its at rest position, extends through an opening 144 in floor 134. The screw has a nut (see FIG. 6) below the floor and a locknut 148 above the floor.

The load cell is carded by the floor of bracket 112 at its end remote from support screw 126. The flexing portion of the load cell is a U-shaped tongue 150 formed by cutting a U-shaped slot 152 in a flat plate 154. Plate 154 is secured against the underside of floor 134 by a screw 156 which extends through a hole 158 in plate 154 near the inner end of the plate, and which is engaged by a nut 160. The outer end of the U-shaped flexing portion 150 has a hole 162 through which a screw 164 extends to engage a contact nut 166. Engagement of nut 166 with the cycle frame during torque-induced rotation of bracket 112 causes flexion of the load cell. The frame-engaging surface of nut 166 is preferably spherical, so that the force of engagement will be exerted at a single point.

A cut-out 168 in the end of floor 134 permits the outer end of the load cell to flex upwardly as the frame is engaged by contact nut 166. An A/D converter circuit board 170 is carded by bracket 112 and is connected by a wire (not shown) to the load cell. The variations in load registered by the load cell, and converted by circuit board 170, are fed into the electronic automatic control system diagramed in FIG. 9.

FIG. 8 shows a cross-section taken through the friction belt 60. A rubber strip 176 is secured to the back of a leather strip 178 to constitute the friction belt 60. The rubber strip, which preferably is formed of relatively soft material, is able to dampen vibrations in the leather strip. As a result, a potential problem has been eliminated.

FIG. 9 diagrams the electronic control system which actuates motor 110 to move pulley 108 to cause tightening or loosening of friction belt 60. The object is to control automatically the work required by the user to drive the rotor 40. The work, which may be measured in watts, is a function of torque and rotation speed. Torque in the present disclosure is measured by the load cell 150. Speed is measured by an optical sensor 180 cooperating with an encoder disk 182 mounted on wheel 40. Various other measurement mechanisms are available.

The choices made for the present electronic system are also taken from a large number of equivalent possibilities. However, they are considered to be the best mode, based on information and experience. A digital control system is used, which includes a microcontroller (CPU) 184, linked by a data bus 186 to a front panel 188 and a memory 190. The front panel 188 provides both a display which supplies information to the user, and a keyboard which permits the user to enter command selections. The display may include current information concerning distance traveled, work output in watts, RPM, time elapsed, etc. Command options may include a selection from programs having work variations during a program, a user-designed program, and a mode switch to choose between an "exercise" mode and a "bicycle simulation" mode. The exercise mode, which is normal in stationary cycles, maintains constant energy by increasing load if the user pedals more slowly, and decreasing load if the user pedals faster. The bicycle simulation mode is distance-based, permitting the user to increase effort and reach the goal sooner, or vice versa.

The torque signal from load cell 150 is fed to A/D converter 170 on line 192, and from converter 170 on line 194 to microcontroller 184, after being amplified at 196. The RPM signal from sensor 180 is fed on line 198 to microcontroller 184, after being amplified at 200.

In the microcontroller, the actual work level is calculated, using the torque and RPM data, and is compared to the work command signal. Control signals are sent to motor 110 if a resistance adjustment is needed between friction belt 60 and the periphery of wheel 40, i.e., if an error signal occurs. In the present configuration, it is convenient to use pulsed signals for control purposes, and to vary pulse width as a function of the size of the error detected (pulse width modulation).

An analog signal representing torque is developed by applying a voltage across the load cell 150. At converter 170, the signal is converted to a digital signal having a modulated pulse width which varies with mount of load cell flexion. The load cell can measure a force in the range of 0–15 lbs., and can flex a distance of up to 0.01 in. The speed signal from the optical sensor 180 is a pulse train whose frequency is proportional to the speed of the drive wheel.

The microcontroller 184 controls the tension of friction belt 60 by means of a pair of signals input to a bridge amplifier circuit whose output causes motor 110 to run in one direction or the other. The control signals sent by microcontroller 184 to motor 110 are pulsed signals having variable pulse widths. Signals to the motor 110 to tighten belt 60 on wheel 40 follow line 202, after amplification at 204. Signals to motor 110 to loosen belt 60 on wheel 40 follow line 206 after amplification at 208. A pulsed signal on line 202 enables a transistor 210 and a transistor 212, in order to connect the left side of motor 110 to a voltage source 214 via line 216, and to connect the right side of motor 110 to ground 218 via line 220. This causes motor 110 to turn in a clockwise direction, tightening belt 60. A pulsed signal on line 206 enables a transistor 222 and a transistor 224, in order to connect the right side of motor 110 to voltage source 214 via line 220, and to connect the left side of motor 110 to ground 218 via line 216. This causes motor 110 to turn in a counterclockwise direction, loosening belt 60.

The only automatically controllable aspect of the system is the friction-created torque load on wheel 40, which is variable under control of motor 110. Although a speed signal is conveyed to microcontroller 184, for the purpose of determining the user's work output, there is no means for automatically controlling speed. The speed is determined solely by the pedaling of the user, and can be varied at any time by the user. The microcontroller computation can determine the motor direction and pulse width, for the purpose of varying the friction between belt 60 and wheel 40. In either the exercise mode or the bicycle simulation mode, a target load is calculated and compared to the load measured by the strain gauge every 25 milliseconds. The difference between the actual and target loads is converted to a motor pulse duration, and the sign of the difference, positive or negative, determines the polarity of the motor signal. A pulse of the specified duration and polarity is output to the motor, which acts to minimize the measured error.

When the drive wheel 40 is at rest, the torque on the motor bracket assembly is zero. However, the resistance measured by the strain gauge contains components other than torque, resulting in an offset value which must be subtracted from the signal. It is not sufficient to take any value measured when the drive wheel is at rest, because if the friction belt is applying a force to the wheel, then an equivalent torque has to be applied before the wheel can be moved. In this case, the force measured immediately before motion begins may be higher than the rest value. Other forces may be applied to the strain gauge, such as frame flexion or recoil from the gear motor, which can lead to measurements below the rest value, which cannot be repeated by loosening the friction belt. It appears that neither a fixed calibration value nor measurement of the lowest value provides a satisfactory offset. A provisional solution to this problem is to sum the duration of tightening pulses, up to some maximum value, and to subtract the duration of loosening pulses from this sum, down to zero. When zero friction is commanded and the tightening sum is greater than zero, a loosening pulse of a duration of half the sum is output to the motor. This appears to be sufficient to slacken the belt. The tightening sum is limited to a maximum because under high loads the belt tension may back-drive the motor, despite the self-energizing configuration. The final loosening pulse is discounted 50% to avoid the situation in which the pulley turns too far in the loosening direction, wraps the belt and reverses the tensioning polarity.

The novel stationary exercise cycle disclosed in this application provides, as stated above, major functional improvements over prior art devices. Because of the single stage feature, i.e., using the same drive wheel to receive user-driving force and to receive braking resistance, it is exceptionally smooth and quiet. The problems inherent in multi-stage devices have been eliminated. Additionally, as compared to most commercial exercise cycles, the range of loads attainable is much wider because of the friction braking. Other cycle devices having friction braking combined with automatic control of the load have not solved the problem of single stage control.

From the foregoing description, it will be apparent that the apparatus disclosed in this application will provide the significant functional benefits summarized in the introductory portion of the specification.

The following claims are intended not only to cover the specific embodiments disclosed, but also to cover the inventive concepts explained herein with the maximum breadth and comprehensiveness permitted by the prior art.

What is claimed is:

1. A stationary exercise cycle, comprising:

a rotor having an outer brake-engaging portion and a central hub portion;

a driving unit for the rotor which includes user-driven pedals, arms carrying the pedals, and a rotating element whose axis of rotation coincides with the axis of rotation of the rotor;

a one-way clutch between the rotating element and the hub of the rotor which permits the rotating element to drive the rotor but not to be driven by the rotor;

a braking device adapted to engage the outer portion of the rotor for the purpose of resisting its rotation in order to create a load opposing the user's effort;

a momentum-storing device; and a connection between the momentum-storing device and the rotor which tends to maintain the rotating speed of the rotor.

2. The stationary exercise cycle of claim 1 which includes; a stationary cylindrical member within which the hub of the rotor is supported.

3. The stationary exercise cycle of claim 2 in which the rotor includes: a cylindrical hub which carries the one-way clutch and the shaft; and a cylindrical periphery which is engaged by the braking device.

4. The stationary exercise cycle of claim 3 which includes: a flywheel which constitutes the momentum-storing device; and a drive belt which engages the periphery of the rotor and which constitutes its connection with the flywheel.

5. The stationary exercise cycle of claim 1 in which the momentum-storing device is a flywheel rotating at a higher speed than the rotor.

6. The stationary exercise cycle of claim 1 in which the braking device includes:

a friction belt which engages the periphery of the rotor; and a motor which causes the friction belt to tighten or loosen on the rotor periphery.

7. The stationary exercise cycle of claim 6 which also comprises:

means under user control for inputting a desired load selection;

means for measuring the actual load on a continuing basis; and means for automatically controlling the motor to minimize the difference between the desired load and the actual load.

8. The stationary exercise cycle of claim 7 in which the load measuring means comprises:

a pivoted member which is caused to move on its pivot by changes in the actual load; and an electro-mechanical device which measures the actual load in response to movement of the pivoted member.

9. The stationary exercise cycle of claim 6 which also comprises:

an anchor which is secured to one end of the friction belt; and a pulley which is secured to the other end of the friction belt and which is driven by the motor.

10. The stationary exercise cycle of claim 8 which also comprises:

an anchor which is secured to one end of the friction belt and which is supported on the pivoted member; and a motor-driven pulley which is secured to the other end of the friction belt and which is supported on the pivoted member.

11. An exercise machine comprising:

a first-stage rotor;

user-operated means for driving the first-stage rotor;

a friction brake adapted to engage the first-stage rotor to provide a variable user-resisting load;

an automatic control system for the user-resisting load, which control system includes (a) means under user control for inputting a desired load selection, (b) means for measuring the actual load on a continuing basis, and (c) electro-mechanical means for adjusting the load to minimize the difference between the desired load and the actual load; and a second rotor which has a driving connection with the first-stage rotor and which acts as a momentum-storing flywheel.

12. The stationary exercise cycle of claim 8 in which the pivoted member exerts force on the electro-mechanical device in a direction which causes substantially linear load change measurement.

13. The stationary exercise cycle of claim 6 in which the braking force tending to tighten the belt is increased by the self-energizing effect of the motor-caused friction.

14. The exercise machine of claim 11, in which:

the user-operated means drives the first-stage rotor without any intervening speed-increasing means.

15. The exercise machine of claim 14 which comprises:

a one-way clutch between the user-operated means and the first-stage rotor which causes user energy to drive the rotor in one direction only.

16. The exercise machine of claim 11 in which the user-operated driving means includes a rotating element whose maximum speed is the rotating speed of the friction braked rotor.

17. The exercise machine of claim 11 in which the first-stage rotor and the user-operated driving means include:

a non-rotatable cylindrical support member;

a rotatable hub which is supported inside the support member and which is connected to the brake-engaging peripheral portion of the rotor;

a rotatable shaft which is inside the hub and which is driven by the user; and a one-way roller clutch between the shaft and the hub.

18. The exercise machine of claim 14, in which the friction brake includes:

a friction belt which engages the periphery of the first-stage rotor; and a motor which causes the friction belt to tighten or loosen on the rotor periphery.

19. The exercise machine of claim 18 which also comprises:

means under user control for inputting a desired load selection;

means for measuring the actual load on a continuing basis; and means for automatically controlling the motor to minimize the difference between the desired load and the actual load.

20. A stationary user-controlled exercise machine comprising:

a rotatable member which is caused to rotate by user-applied energy;

a friction belt adapted to engage the rotor periphery to provide a variable user-resisting load;

a motor which causes the friction belt to tighten or loosen on the rotor periphery;

an anchor which is secured to one end of the friction belt;

a pulley which is secured to the other end of the friction belt and which is driven by the motor; and an automatic control system for the user-resisting load, which control system includes (a) means under user control for inputting a desired load selection, (b) means for measuring the actual load on a continuing basis, and (c) electro-mechanical means for adjusting the load to minimize the difference between the desired load and the actual load;

the means for measuring the actual load comprising a pivoted member which is caused to move on its pivot by changes in the actual load, and an electrical device which measures the actual load in response to movement of the pivoted member.

21. The exercise machine of claim 20 in which the anchor is supported on the pivoted member and the pulley is also supported on the pivoted member.

22. The exercise machine of claim 20 in which the pivoted member exerts force on the electrical device in a direction which causes substantially linear load change measurement.

23. The exercise machine of claim 22 in which the electrical load-measuring device is located on the end of an arm extending a substantial distance from the pivotal center of the pivoted member.

24. The exercise machine of claim 21 in which both the anchored end of the friction belt and the pulley end of the friction belt are located essentially tangential to an imaginary circle centered at the pivotal center of the pivotal member.

* * * * *